United States Patent [19]

Krammer

[11] 4,030,423

[45] June 21, 1977

[54] MATERIAL HANDLING SYSTEM

[75] Inventor: Robert Krammer, Royal Oak, Mich.

[73] Assignee: Standard Conveyor Company, N. St. Paul, Minn.

[22] Filed: Nov. 29, 1974

[21] Appl. No.: 528,322

[52] U.S. Cl. ..... 104/172 S; 198/680

[51] Int. Cl.[2] ..... B61B 13/00

[58] Field of Search .... 198/177 T, 177 R, DIG. 19, 198/680; 104/107, 108, 109, 172 C, 172 BT, 172 S, 88, 243, 242

[56] References Cited

UNITED STATES PATENTS

| | | | |
|---|---|---|---|
| 3,044,416 | 7/1962 | Reibel et al. | 104/172 S |
| 3,230,897 | 1/1966 | Orwin | 104/172 S |
| 3,285,195 | 11/1966 | Babson | 104/172 BT |
| 3,391,652 | 7/1968 | Lauber | 104/243 X |
| 3,664,267 | 5/1972 | Di Rosa | 104/172 S |
| 3,726,233 | 4/1973 | Swartz | 104/172 S |
| 3,793,965 | 2/1974 | Winters | 104/172 S |
| 3,830,165 | 8/1974 | Turner | 104/172 S |
| 3,874,304 | 4/1975 | Robert | 104/172 S |

FOREIGN PATENTS OR APPLICATIONS

| | | | |
|---|---|---|---|
| 1,131,058 | 10/1968 | United Kingdom | 104/172 S |

*Primary Examiner*—L. J. Paperner
*Assistant Examiner*—James M. Slattery
*Attorney, Agent, or Firm*—Harness, Dickey & Pierce

[57] ABSTRACT

A material handling system for conveying or accumulating parts between work stations. The system permits accumulation in all portions of a closed loop, including upwardly or downwardly extending legs. The system comprises a series of trolleys supported for free movement alongside a powered endless member, each trolley having a retarding dog and a driven dog. In the downwardly extending legs, the retarding dogs normally rest against driving dogs on the constantly moving endless member, and are thus transported at a controlled rate. If trolleys are obstructed on these legs and are to be accumulated, the driving dogs will slip past the retarding dogs, which are resiliently mounted. If no accumulation is needed on an upward leg, a fixed cam immediately before this leg moves the driven dog of each trolley into position to be engaged by a driving dog. If accumulation is desired on an upward leg, a fixed member alongside the leg will hold the retarding dog in position to be engaged by a driving dog so that the trolley may be driven upwardly until it reaches a fixed retaining pawl which will keep it from dropping back. Retaining pawls may be provided for individual or stacks of trolleys, depending on weight. Components are disclosed for either upwardly cascading or downwardly cascading accumulation. Release of accumulated trolleys on an upward leg is by swinging the driven dogs into position to be engaged by driving dogs.

28 Claims, 11 Drawing Figures

MATERIAL HANDLING SYSTEM

BACKGROUND OF THE INVENTION

The invention relates to the movement and accumulation of parts in industrial operations, and is particularly concerned with the transfer of workpieces in such processes as sequential machine tool operations. In many instances, these operations are set up in a limited space which prevents the accumulation of parts in long horizontal stretches.

BRIEF SUMMARY OF THE INVENTION

It is an object of the present invention to provide a novel and improved material handling system which is adaptable for a wide variety of space conditions and permits both the transfer and accumulation of workpieces in all sections of the system, whether upwardly or downwardly inclined, thus permitting much greater workpiece accumulation for a given space.

It is also an object to provide an improved system of this nature which utilizes a power-and-free conveyor system but imposes relatively light loads on the driving chain during accumulation.

It is another object to provide an improved system which obviates the need for mechanical devices to cause disengagement between the driving chain and the driven members during accumulation.

It is a further object to provide an improved conveyor and storage system of this character which may utilize a wide variety of different powered chains with driving dogs.

It is also an object to provide a novel in-process conveyor and storage system of this type which will be capable of handling workpieces of widely varying lengths without the danger of overlapping or skewing of the conveyor trolleys.

Briefly, the system comprises a powered endless member having spaced driving dogs, a series of workpiececarrying trolleys supported for free movement alongside said endless member, a retarding dog on each trolley engageable with a driving dog on a downwardly leg of the system whereby a trolley will be moved by gravity along with the driving dog, a driven dog carried by each trolley, means supporting said retarding and driven dogs in a manner permitting the driving dogs to pass both dogs on a blocked trolley in a downwardly extending conveyor leg, and means for moving the driven dog on each trolley into the path of said driving dogs whereby the driving dogs may lift the trolleys.

Where no accumulation is required on an upward conveyor leg, the means for moving the driven dogs into the path of the driving dogs is located immediately before the start of such leg. Where accumulation on an upward leg is required, the means for moving the driven dogs into the path of the driving dogs is selectively operated at the upper end of an accumulated stack of trolleys. In these embodiments, means are provided at the beginning of the upward leg for preventing movement of the retarding dogs out of the path of the driving dogs so that the driving dogs drive the trolleys by means of the retarding dogs into the accumulation area.

DESCRIPTION OF THE PREFERRED EMBODIMENTS

Figure 1:
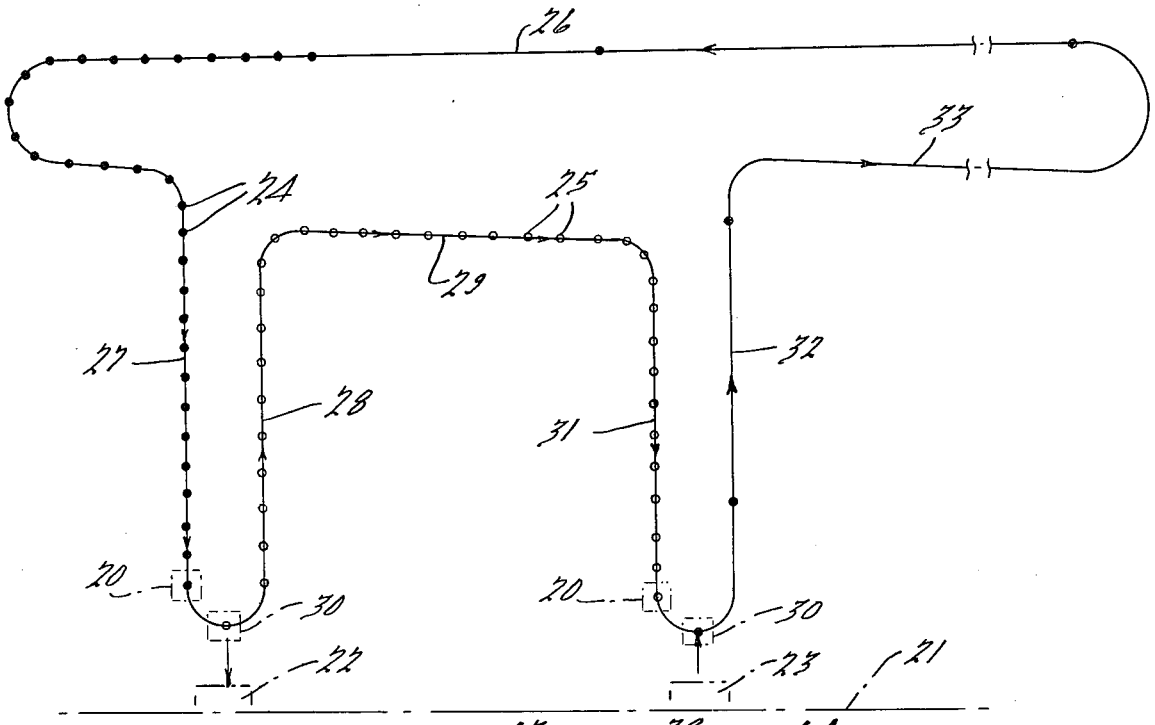
FIG. 1 is a schematic layout of a material handling system utilizing the principles of the invention.

Referring first to FIG. 1, the system of this invention is usable in a closed loop conveyor system, and is especially adapted for locations where horizontal space is limited. Typically, the system is installed above a floor 21 having a first station 22 at which parts are unloaded for processing and a station 23 where parts are reloaded on to the conveyor trolleys. Loaded trolleys are thus indicated at 24 and empty trolleys, between stations 22 and 23, at 25, these reference numerals being for FIG. 1 only. Accumulation of trolleys may be required between stations 22 and 23 or possibly before station 22 or after station 23. Conventional stop and escapement units 20 are shown before stations 22 and 23 for this purpose, with additional stop units 30 at the stations themselves for trolleys released from units 20. If necessary, units 30 could include conventional "kickers" for restarting the trolleys. The system is shown as having an upper leg 26 which may be inclined slightly downwardly, a downwardly extending vertical leg 27 before station 22, an upwardly extending leg 28, downwardly inclined leg 29 and vertically downwardly extending leg 31 between stations 22 and 23, and an upwardly extending section 32 after station 23. These sections are of course connected by intermediate sections, such as downwardly inclined and then upwardly curved leg 33 leading to 26. Legs 26 and 33 are broken to indicate that their lengths could be varied depending upon the amount of accumulation required.

Figure 2:
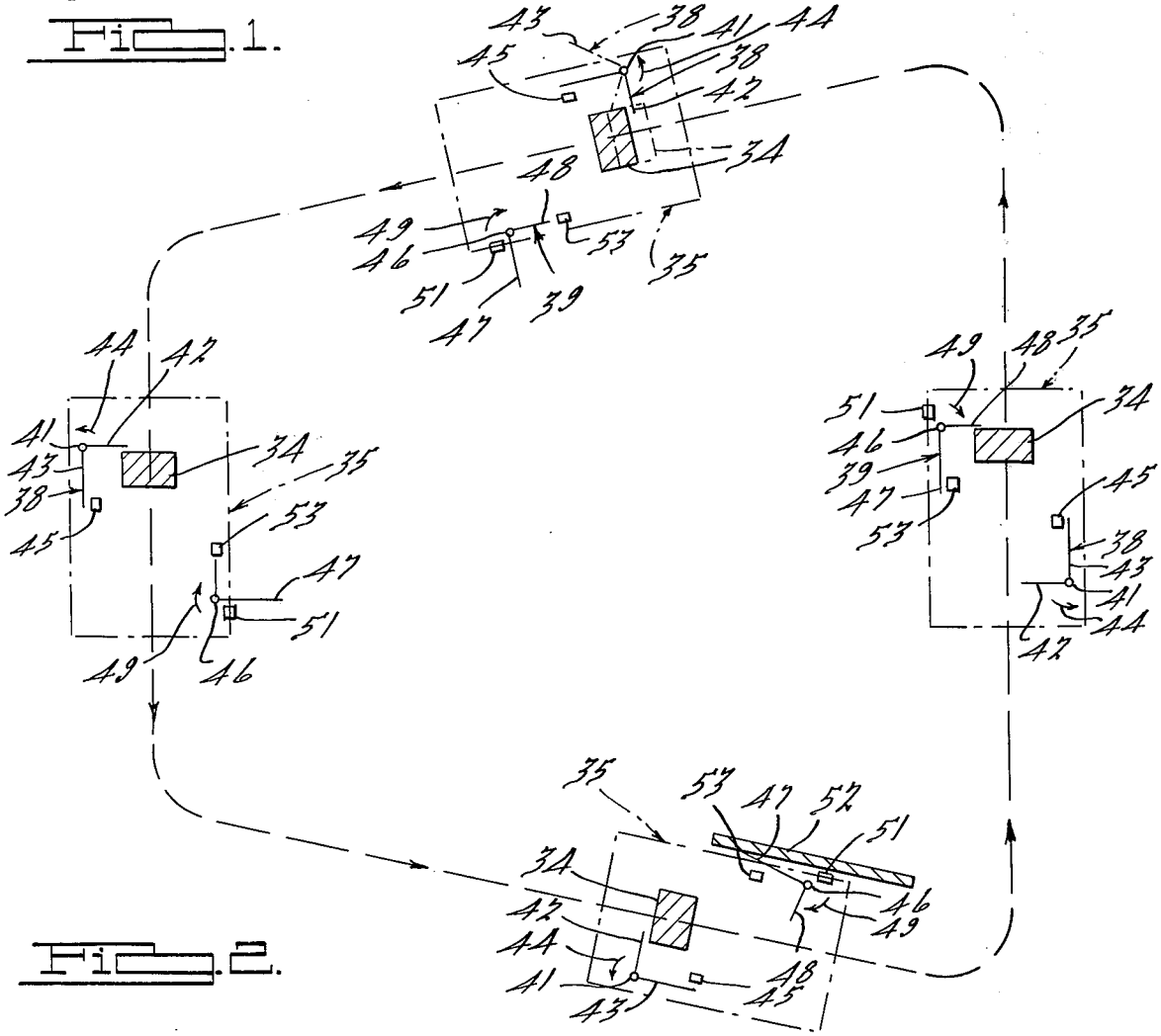
FIG. 2 is a schematic view of a simplified system showing how the trolley dogs interact with the driving dogs on different legs, this system requiring no accumulation on the upward leg.

FIG. 2 illustrates schematically the principles of construction of the invention using a simplified loop having only two downwardly inclined legs connected by a downward vertical and upward vertical leg. A power-and-free conveyor system is used in which an endless member having a series of driving dogs 34 runs alongside rails which support a series of trolleys generally indicated at 35. The endless member may be a chain such as that indicated generally at 36 in FIG. 4, and described more fully below. The fixed trolley rails are indicated at 37 in FIG. 3. Being conventional, the rails and chains are omitted from FIG. 2 for purposes of clarity.

Each trolley 35 carries a retarding dog generally indicated at 38 and a driven dog generally indicated at 39. Retarding dog 38 is generally L-shaped, being pivoted at 41 and having a first arm 42 and a second arm 43. Resilient means 44 are provided urging retarding dog 38 toward a retarding position in which arm 43 engages a stop 45 and is parallel to the direction of trolley movement, while arm 42 is transverse to this movement and in the path of driving dogs 34.

Driven dog 39 is pivotally mounted at 46 forwardly of dog 38 and on the other side of the path of movement of driving dog 34. Dog 39 is also L-shaped, having a first arm 47 and a second arm 48. The dog is urged by resilient means 49 toward a free position in which arm 47 engages a stop 51 and extends outwardly from the trolley, while arm 48 is parallel to the direction of movement but clear of driving dogs 34.

Figures 9, 10, 11:
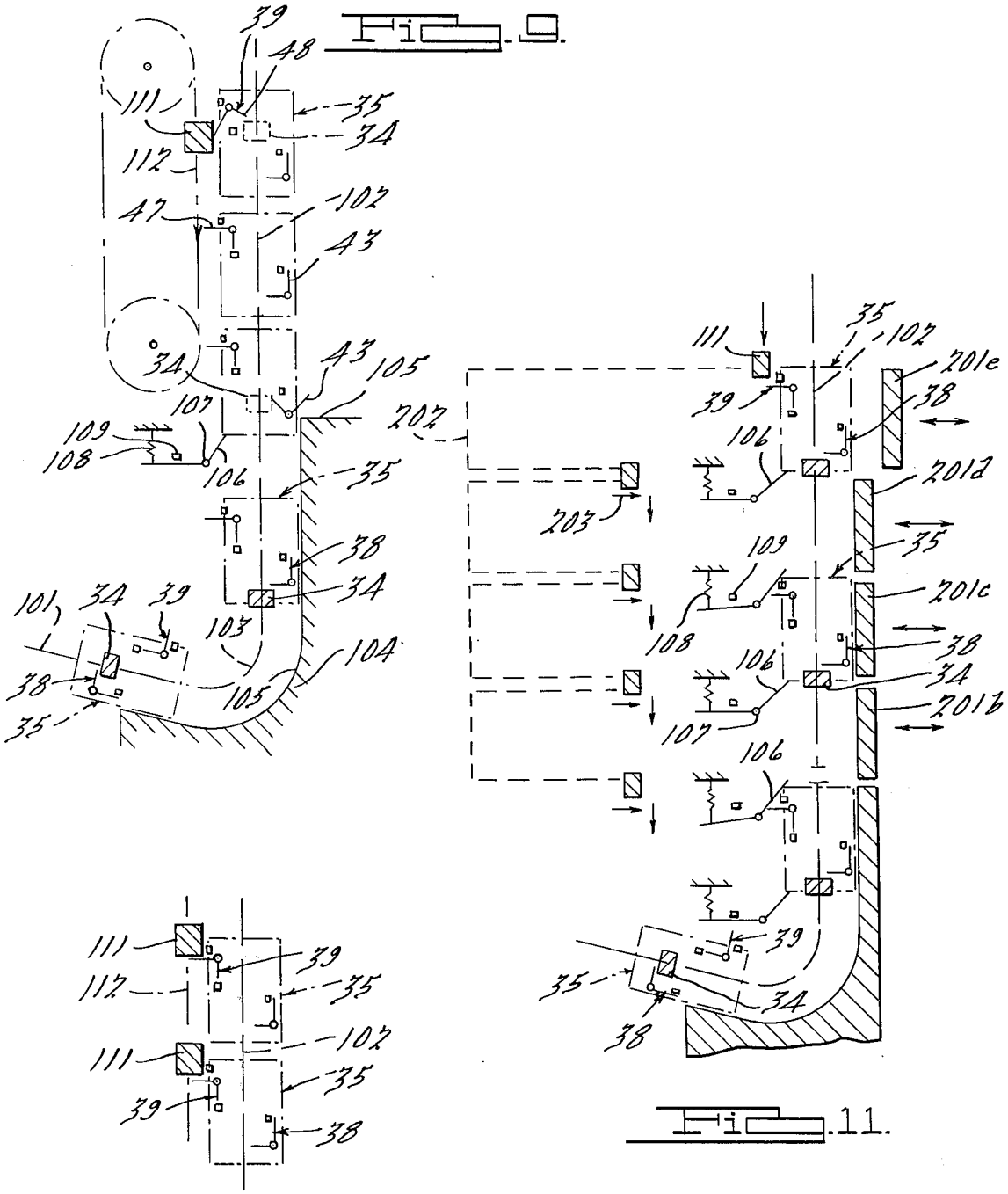
FIG. 9 is a schematic view of a portion of the invention having upwardly cascading accumulation on an upward leg of the conveyor.
FIG. 10 is a partial diagrammatic view of a modified form of the embodiment of FIG. 9 in which a plurality of trolley release cams are provided for swinging the driven dogs of the trolleys into the path of the driving dogs.
FIG. 11 is a diagrammatic view of still another embodiment of the invention in which holding pawls are provided for individual trolleys and accumulation is downwardly cascading.

Both dogs 38 and 39 are movable away from the directions in which they are urged by their respective resilient means. In the case of dog 38, if a trolley 35 is obstructed and is to be accumulated, a driving dog 34 approaching from the rear will engage arm 42 and swing dog 38 counterclockwise in FIG. 2 toward a free position clear of the driving dog (see dot-dash position at top of FIG. 2). The latter will slip past the retarding dog which will snap back into position. This exerts a minimal amount of resistance on chain 36. If a fixed member alongside the path of the trolley 35 prevents this swinging movement of dog 38, a driving dog 34 which engages it from the rear will push the trolley. This feature is used when it is desired to accumulate on upward legs. (FIGS. 9–11).

Driven dog 39 is swung from its free position to a driven position when its arm 47 encounters a fixed cam 52, so that arm 48 will be swung into the path of an approaching driving dog 34 (see bottom of FIG. 2). Such a cam 52 is used when no accumulation on the next upward leg is required, and is placed immediately before the beginning of such upward leg. During the downward legs, the trolleys are advanced by gravity with arms 42 of retarding dogs 38 resting against the rear of constantly moving driving dogs 34. However, at the end of the last downward leg, the trolleys will slow down and driving dogs 34 will pull away from arms 42 of the retarding dogs and engage arms 48 of the driven dogs which have been swung into their path by cam 52. The driving dogs will thus lift the trolleys by means of the driven dogs. For this purpose, a stop 53 is provided on each trolley engageable by arm 47 of driven dog 39. This stop will hold the driven dog in its driven position.

As soon as the top of the upward leg is passed, the force of gravity will cause trolley 35 to pull forwardly with respect to its driving dog 34. Driven dog 39 will be released from the driving dog and its resilient means 49 will swing it again into the position shown at the top of FIG. 2, against stop 51. At the same time, arm 42 of retarding dog 38 will engage the back of the driving dog and the trolley will be advanced by gravity as before.

Figure 3:
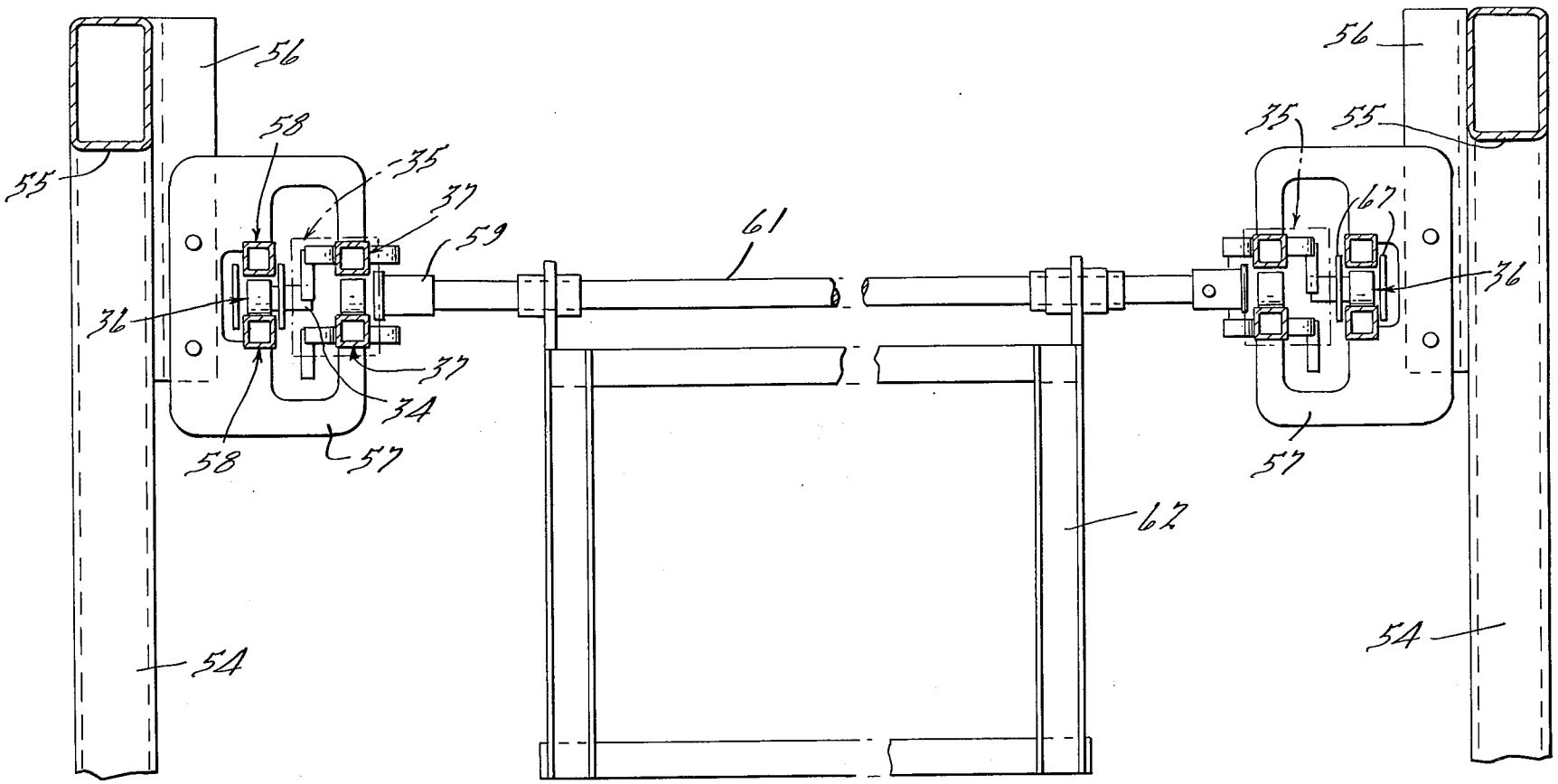
FIG. 3 is a partially diagrammatic view, parts being omitted, showing a suitable construction for utilizing the invention in a power-and-free conveyor system.

FIG. 3 illustrates a suitable manner of utilizing a trolley 35 in a material handling system. Horizontally spaced posts 54 support frame members 55 from which depend brackets 56. C-shaped supports 57 are secured to these brackets. The supports hold, at suitably spaced intervals, upper and lower chain rails generally indicated at 58 between which is disposed the chain generally indicated at 36. Pairs of upper and lower trolley rails 37 are also held by supports 57 inwardly of chain rails 58. The trolleys are in pairs, with each trolley 35 having an inwardly extending trunnion 59. A work supporting shaft 61 extends between the trunnions of each pair of trolleys 35. Shaft 61 is shown as supporting a frame 62 for holding a workpiece which depends from the shaft. In practice, the length of each trolley will be such that, regardless of the direction of the conveyor section, adjacent trolleys will be sufficiently spaced to prevent the interference between the workpieces or their carriers.

Figure 4:
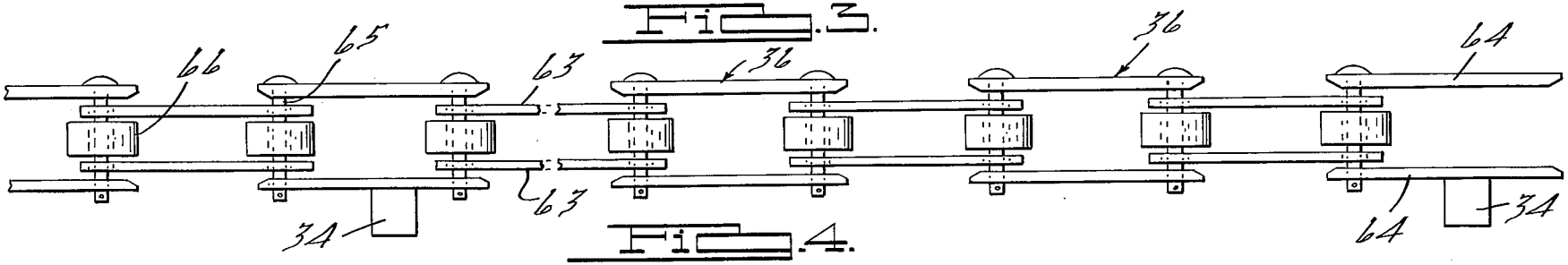
FIG. 4 is a top plan view of a section of suitable powered chain carrying the driving dogs.
Figure 5:
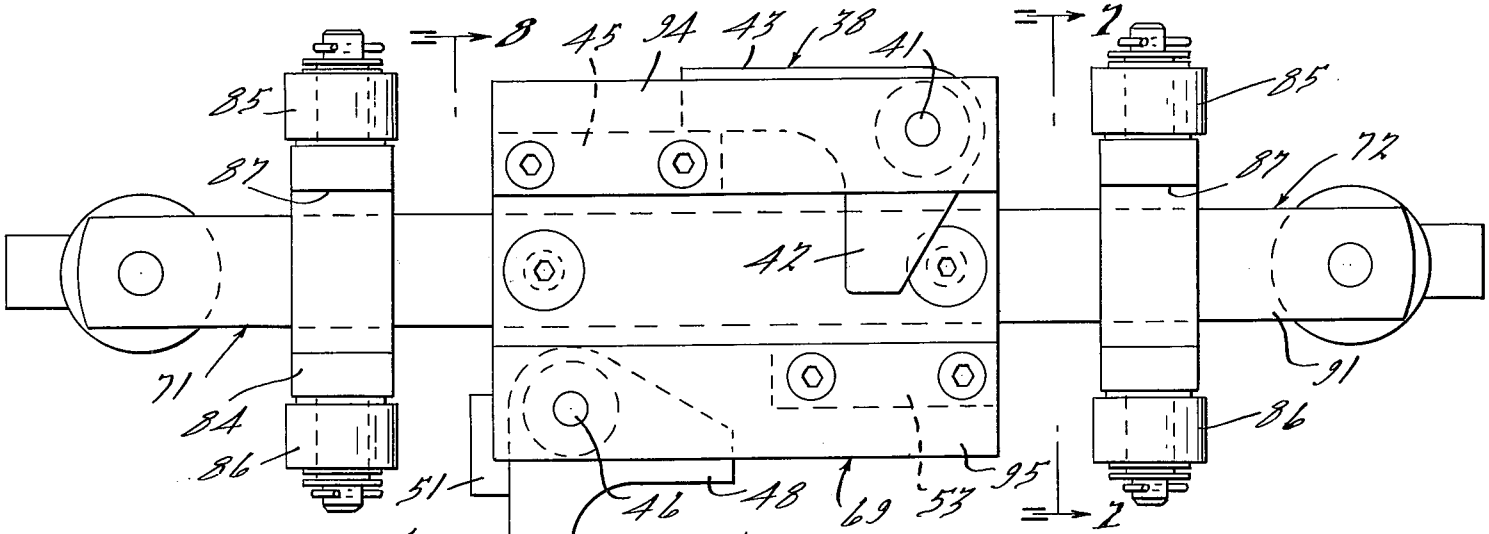
FIG. 5 is a side elevational view of a trolley.
Figure 6:
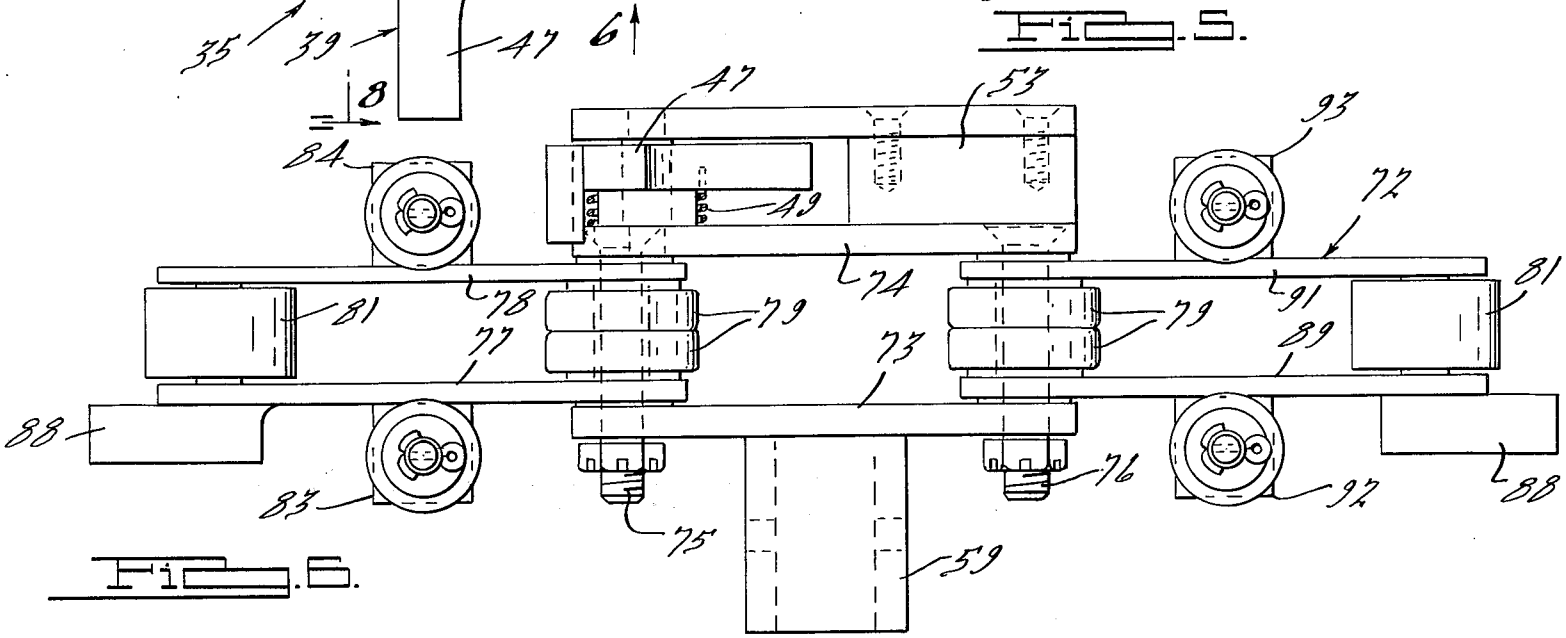
FIG. 6 is a bottom plan view of the trolley looking in the direction of the arrow 6 of FIG. 5.
Figure 7:
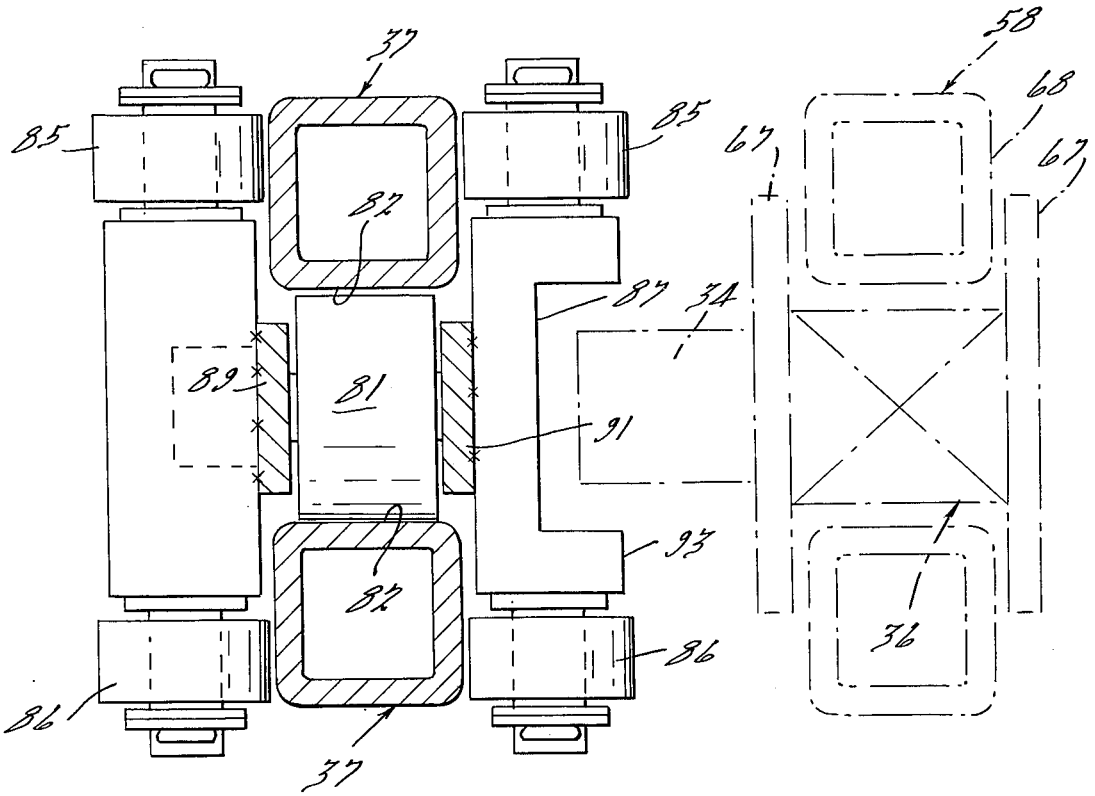
FIG. 7 is a cross-sectional view in elevation taken along the line 7—7 of FIG. 5 and showing the coaction of the trolley with the fixed rails.
Figure 8:
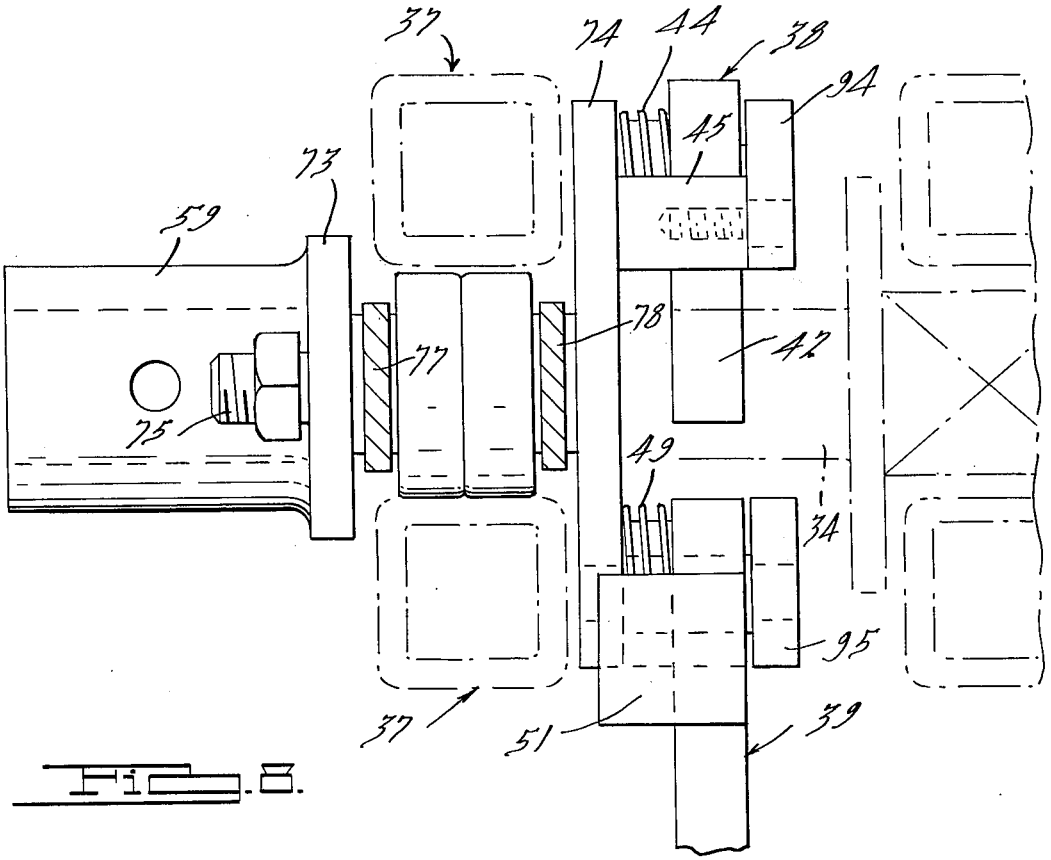
FIG. 8 is a cross-sectional view in elevation taken along the lines 8—8 of FIG. 5.

A suitable chain 36 is shown in FIG. 4. The chain has inner links 63 and outer links 64, driving dogs 34 being attached at evenly spaced intervals to the outer links on one side. The links are connected by pivots 65 on which are mounted rollers 66, the latter engaging upper and lower rails 58. If desired, wear plates 67 may be mounted on the chain to engage the sides 68 of box shaped rails 58 (FIGS. 3 and 7). The arrangement is such that driving dogs 34 will project horizontally inwardly toward trolleys 35.

The construction of trolley 35 is best seen in FIGS. 5 to 8. The trolley is made up of three sections, a central section generally indicated at 69, a forward guide section generally indicated at 71 and a rear guide section generally indicated at 72. Central section 69 comprises a trunnion supporting plate 73, a spaced dog supporting plate 74, and connecting bolts 75 and 76. These bolts act as pivots, with forward section 71 being mounted on pivot 75 and rear section 72 on pivot 76. The forward section has spaced plates 77 and 78 mounted at one end on pivot 75, with roller-spacers 79 between. The forward ends of these plates carry a roller 81 engageable with inner surfaces 82 of rails 37 which are of box shaped cross-section. The outsides of plates 77 and 78 carry brackets 83 and 84 respectively. A roller 85 is rotatably mounted at the top of each bracket, these rollers engaging the opposite sides of upper rail 37. Lower rollers 86 carried by these brackets engage the sides of the lower rail 37. Bracket 84 has a central clearance recess 87 for driving dogs 34. A bumper 88 is secured to the forward end of plate 77 and extends forwardly therefrom, being engageable with a similar bumper on the rear of the next forward trolley.

Rear section 72 is constructed similarly to section 71, having spaced side plates 89 and 91, brackets 92 and 93 with upper and lower rollers 85 and 86 engageable with the sides of rail 37, a central roller 81 engageable with the inside rail surfaces, a clearance recess 87 in bracket 93, and a bumper 88. Plates 89 and 91 are mounted on pivot 76 and have spacers 79 therebetween. The articulated nature of the trolley and particularly the forward and rear portions carrying bumpers 88, will ensure that they are securely guided by the rails regardless of the load length and will not overlap or skew with respect to one another.

A retarding dog supporting plate 94 and a driven dog supporting plate 95 are secured in spaced relation with each other and with dog supporting plate 74. The space between plates 94 and 95 is in the path of and slightly wider than driving dogs 34. Retarding dog 38 is mounted on pivot 41 between the rearward ends of plates 74 and 94, resilient means 44 comprising a helical spring surrounding the pivot. The spring urges dog 38 counterclockwise in FIG. 5 so that arm 43 will engage stop 45 which extends between the forward portions of plates 74 and 94. Arm 42 will then project into the space between plates 94 and 95. The outer surface of arm 43 will be flush with or slightly outside of the outer edges of plates 74 and 94.

Pivot 46 extends between the forward portions of plates 74 and 95, with driven dog 39 being mounted thereon. Resilient means 49 comprise a helical spring surrounding the pivot, urging dog 39 clockwise so that arm 47 will engage stop 51 which extends between the forward ends of plates 74 and 95. At this time no portion of dog 39 projects into the space between plates 94 and 95. However, when arm 47 is engaged by cam 52 (FIG. 2) or by actuating cams to be described later with respect to FIGS. 9 to 11, the counterclockwise movement will cause arm 48 to project into this space. When a driving dog engages arm 48 it will swing arm 47 against stop 53 which extends between the rearward portions of plates 74 and 95.

The operation of the system of FIGS. 2 to 8 will be apparent from the foregoing description. During a downward leg of the conveyor, the force of gravity will cause trolleys 35 to ride down their respective rails with arms 42 of retarding dogs 38 engaging the backs of the chain driving dogs. The trolleys will thus move at a controlled rate depending upon the chain speed. Should a trolley encounter an obstruction and be halted on a downward leg, accumulation will begin. Driving dogs 34 will continue to advance past retarding dogs 38, the only resistance to movement being relatively weak springs 44. When it is desired to begin trolley movement again, removal of the obstruction to the leading trolley 35 will permit the force of gravity to move that trolley and therefore succeeding trolleys against the backs of driving dogs 34 and they will move as before. Any desired number of trolleys may be released from accumulation at any time.

Just before the beginning of an upward conveyor leg in which no accumulation is required, fixed cam 52 will be engaged by arm 47 of each driven dog 39. This will cause arm 48 to move into the path of driving dog 34 which will continue to advance as trolley 35 slows down and stops at the end of the downward leg. Once driving dog 34 engages arm 48, it will swing driven dog 39 until arm 41 engages stop 53. Thenceforth, lifting of the trolley will be through driven dog 39.

As each trolley reaches the top of an upward leg and arrives on a downward leg, the force of gravity will cause the trolley to move faster than driving dog 34. This will release driven dog 39 which will return to its free position by virtue of spring 49. Arm 42 of retarding dog will again engage the back of the driving dog so that further transfer movement or accumulation will be as described above. The lost motion which takes place when driving dogs 34 moves between retarding dog 38 and driven dog 39 will be of no significance when continuous production is in progress.

FIGS. 9 to 11 shown several arrangements for permitting accumulation of trolleys in an upward leg, in addition to the downward legs. In FIG. 9, the system is shown as having a downward leg 101 leading to an upward leg 102. As trolleys 35 approach a juncture 103 between the two legs, driven dogs 39 are not swung into their driven position as they were by cam 52 in FIG. 2. Instead, as each trolley 35 slows down at the bottom of leg 101, the driving dog 34 on which its retarding dog 38 has rested will move ahead. The next driving dog 34 will engage the back of arm 42 on the retarding dog 38 of the trolley 35 and will more it along. Ordinarily, the driving dog 34 would be able to slip past this retarding dog which is merely held in position by spring 44. However, a fixed member 104 is provided adjacent juncture 103 and extends upwardly along leg 102. The surface 105 of this member is immediately adjacent the outside of arm 43 of retarding dog 38. This will prevent the retarding dog from being swung to its free position so as to clear driving dog 34. The result will be that retarding dog 38 becomes, in effect, a "driven" dog, and driving dog 34 will lift trolley 35 along leg 102.

This action will continue until the top 105 of member 104 is reached, at which point dog 38 will swing clockwise and permit driving dog 34 to pass it. However, a holding pawl 106 is mounted on a fixed pivot 107 adjacent top 105 of member 104. The pawl is urged by a spring 108 in a direction urging it toward the path of trolleys 35, the swinging movement being limited by a stop 109. After the central section 69 of a trolley 35 brushes past pawl 106, it will snap into position beneath a corner of the trailing end of the trolley, for example the back edge of plate 73. This will occur just before dog 38 is released by reaching the end 105 of member 104. The trolley will thus be held from dropping.

As each succeeding trolley is fed upwardly in the same manner, it will advance those in front of it so that an upwardly cascading accumulation takes place. In the embodiment of FIG. 9, suitable for relatively light installations and workpieces, a single holding pawl 106 will be sufficient to support the accumulated stack.

Means are provided for releasing trolleys from the top of the accumulated stack as required. This means comprises an actuating cam 111 engageable with the projecting arms 47 of driven dogs 39, to swing them into a driven position in which the arms 48 are in the path of driving dogs 34. Various arrangements for supporting and moving cams 111 may be provided. FIG. 9 shows cam 111 as being mounted on an endless member 112 adjacent conveyor section 102 and movable downwardly to engage successive dogs 39 beginning with that on the uppermost accumulated trolley 35. With this arrangement a selected number of trolleys may be released in succession.

FIG. 10 shows another arrangement for cams 111 in which a plurality of cams are provided instead of a single cam, the cams being spaced along section 102 and being interconnected by means 112. With this arrangement all accumulated trolleys 35 having cams 111 adjacent their positions will be simultaneously caused to be lifted out of their accumulated position, if the spacing of driving dogs 34 is approximately the same as the length of the trolleys. The arrangement of FIG. 10 may be used where, at certain times only, no accumulation is desired in the upward leg of the system.

FIG. 11 shows still another arrangement for upward accumulation which differs in two respects from that of FIG. 9. First of all, a holding pawl 106 is provided for each trolley 35 in the accumulated stack, rather than a single pawl supporting all the trolleys. This adapts the system for heavier loads. Secondly, instead of a single fixed member 104 for converting retarding dogs 38 to driven dogs, a plurality of movable members 201*a*, 201*b*, 201*c*, etc. are provided along upward leg 102 of the system. Each member is selectively movable into and away from a position adjacent trolleys 35 in which they prevent swinging of retarding dogs 38 to their free position and convert them into driven dogs. The number of individually movable members 201 in relation to the lengths of trolleys 35 and the spacing of driving dogs 34 is such that downwardly cascading accumulation in the manner about to be described may occur.

In operation of the system of FIG. 11, if no accumulation is desired on upward leg 102 of the conveyor system, all members 201 will be in the left hand position adjacent trolleys 35. They will thus hold all dogs 38 in position to be driven by driving dogs 34 and there will be no accumulation.

If it is desired to accumulate trolleys beginning at a known height, says the location of member 201*e*, this member will be withdrawn to the right, away from its dog holding position. Thus, when a trolley 35 reaches this height, its dog 38 will be released and the trolley will be held in place by holding pawl 106, as driving dog 34 moves past.

As the next trolley 35 approaches the position of member 201*d* this member will also be withdrawn to the right and the trolley will be held in the next lower position. This action will continue until the desired number of trolleys has been accumulated. The members 201 above will stay in their withdrawn position.

As before, actuating cams 111 are provided for causing trolleys to be withdrawn from accumulation. Since the location of the beginning of the accumulated stack is known, it is unnecessary that means be provided for seeking this location. A first cam 111 mounted at this location is movable downwardly to swing its driven dog 39 into driven position to be engaged by a driving dog 34. Means 202 may be provided interconnecting the uppermost actuating cam 111 with that next below so that when the first cam is moved downwardly, the second cam will be moved into operative position ready to release the next trolley, as indicated by the horizontal arrow 203. This cam will in turn be connected with the next cam and so on down the line.

It will be understood that, in any given system, both nonaccumulating and accumulating upward legs could be provided, the former having actuating cams 52 and the latter actuating cams 111. On runs over long floor distances it may be desirable to provide truly horizontal conveyor legs, since the loss of elevation would not permit downwardly inclined legs. In such legs one could provide an actuating cam 52 to swing driven dogs 39 to their driven position, so that the trolleys are power-driven rather than fed by gravity.

All motions in the system are controlled and interlocked in a conventional manner (hydraulic, electrical or mechanical) to prevent jams or collisions which could damage the system components or the workpieces.

It is to be understood that the foregoing description is that of preferred embodiments of the invention. Various changes and modifications may be made without departing from the spirit and scope of the invention as defined by the appended claims.

What is claimed is:

1. In a material handling system having downwardly and upwardly extending conveyor legs, a powered endless member movable along a path carrying driving dogs, a series of workpieces carrying trolleys supported for free movement alongside said endless member, first means on each trolley movable between a retarding position coacting with a driving dog during travel on a downward leg to cause movement of the trolley with the driving dog, and a free position clear of the path of said driving dogs, second means on each trolley movable between a free position clear of the path of said driving dogs and a driven position in said path, means urging said second means toward its free position causing said driving dogs to pass both said first and second means of a blocked trolley, and actuating means for moving said second means to its driven position, said actuating means being selectively operable and located alongside an upward leg of the conveyor, means extending from the bottom of said upward leg to a predetermined height for preventing movement of said first means from its retarding position, causing a driving dog to engage said first means to lift a trolley to said predetermined height, and holding means at said predetermined height for preventing said trolley from dropping.

2. In a trolley for use in conjunction with a closed loop power-and-free material handling system having an endless member movable along a path with spaced driving dogs, anti-friction means on said trolley engageable with rails of the system, parallel plates carried by the trolley, a retarding dog and a driven dog pivotally mounted between said plates on opposite sides of the path of said driving dogs, each dog having first and second arms, the retarding dog being movable between a retarding position in which the first arm is in the path of said driving dogs and its second arm is substantially parallel to the outer edges of said plates, and a free position in which said first arm is clear of said driving dogs, a spring urging said retarding dog in its retarding position, a stop carried by said trolley for preventing movement of said retarding dog past its retarding position when the retarding dog engages a driving dog, said driven dog being mounted forwardly of said retarding dog and movable between a free position in which its first arm is clear of said driving dog path and said second arm projects from said plates, and a driven position in which said first arm is in the path of said driving dogs and said second arm is parallel to the outer edges of said plates, a spring urging said driven dog toward its free position, a stop carried by said trolley preventing movement of said driven dog past its free position, and another stop carried by said trolley for preventing movement of said driven dog past its driven position when engaged by a driving dog.

3. A rail-supported trolley for use in conjunction with a power-and-free material handling system having an endless member movable along a path with lateral driving dogs, the system having upwardly and downwardly extending legs, said trolley comprising a central section, a forward section and a rear section, pivots connecting the forward end of the central section with the forward section and the rear of the central section with the rear section, rollers carried by said pivots and engageable with said rails for guiding the trolley, rollers carried by the forward section and the rear section for engaging said rails, side rollers carried by the forward and rear sections for engaging the sides of said rails, bumpers carried by the forward end of the forward section and the rear end of the rear section, first means on said central section movable between a retarding position coacting with the driving dog of said endless member during travel on a downward leg to cause movement of the trolley with the driving dog, and a free position clear of the path of said driving dogs, resilient means urging said first means toward its retarding position, second means on said trolley movable between a free position clear of the path of said driving dogs and a driven position in said path, resilient means urging second means toward its free position whereby said driving dogs are permitted to pass both dogs of a trolley when the trolley is blocked, and actuating means for moving said second means to its driven position.

4. A rail-supported trolley for use in conjunction with a power-and-free material handling system having an endless member movable along a path with lateral driving dogs, the system having upwardly and downwardly extending legs, said trolley comprising a central section, a forward section and a rear section, pivots connecting the forward end of the central section with the forward section and the rear of the central section with the rear section, rollers carried by said pivots and engageable with said rails for guiding the trolley, rollers carried by the forward section and the rear section for engaging said rails, side rollers carried by the forward and rear sections for engaging the sides of said rails, bumpers carried by the forward end of the forward section and the rear end of the rear section, a retarding dog pivotally mounted on said trolley on one side of the path of movement of said driving dogs, a driven dog pivotally mounted on said trolley on the other side of said path of movement, each dog on said trolley having first and second arms, the retarding dog being movable between a retarding position in which its first arm is in the path of movement of the driving dogs and its second arm is parallel to said path of movement, and a free position in which the first arm is clear of said path of movement, a spring urging said retarding dog toward its retarding position, a stop preventing movement of said retarding dog past its retarding position when the retarding dog engages a driving dog on a downward leg of the system, the driven dog being movable between a free position in which its arm is clear of said path of movement of the driving dogs and its second arm projects outwardly from the trolley, and a driven position in which the first arm is in said path of movement of the driving dogs and its second arm is parallel to said path of movement, a spring urging said driven dog toward its free position, a stop preventing movement of said free dog past its driven position by said spring, and another stop preventing movement of said driven dog past its driven position when engaged by a driving dog.

5. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog comprising a member pivotally mounted on said trolley and having a first arm in the path of movement of the trolley when the retarding dog is in the retarding position, resilient means urging the retarding dog into its retarding position, a driven dog carried by each trolley means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means located immediately before the start of an upwardly extending leg and including a fixed cam for moving the driven dog of each trolley into the path of said driving dogs to cause a driving dog to lift the trolley along an upwardly extending leg of said conveyor, said driven dog having a first arm engageable by said fixed cam and a second arm movable into the path of said driving dogs in response to engagement of said first arm by said fixed cam, said retarding dog and driven dog being on opposite sides of the path of movement of said driving dogs with said retarding dog being behind said driven dog in the direction of movement of said trolley.

6. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, means located alongside an upwardly extending leg of said conveyor in obstructing relation with a portion of said retarding dog to prevent movement of the retarding dog to its free position to cause a driving dog to lift said trolley by means of said retarding dog, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means for moving the driven dog of each trolley into the path of said driving dogs causing a driving dog to lift the trolley along an upwardly extending leg of said conveyor, said actuating means comprising at least one cam alongside said upwardly extending conveyor leg, each driven dog comprising a first arm engageable by said cam and a second arm movable into the path of movement of said driving dogs in response to engagement with the first arm by said cam, and a support for said cam extending parallel to the path of said trolleys, said cam being movable along said path to engage the driven dogs of successive accumulated trolleys.

7. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, means located alongside an upwardly extending leg of said conveyor in obstructing relation with a portion of said retarding dog to prevent movement of the retarding dog to its free position to cause a driving dog to lift said trolley by means of said retarding dog, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means for moving the driven dog of each trolley into the path of said driving dogs causing a driving dog to lift the trolley along an upwardly extending leg of said conveyor, said actuating means comprising a plurality of cams alongside said upwardly extending conveyor leg adjacent the locations of a number of accumulated trolleys, each driven dog comprising a first arm engageable by a cam and a second arm movable into the path of movement of said driving dogs in response to engagement with a first arm by a cam, and means for simultaneously moving said cams to cause all of said trolleys to be simultaneously released from their accumulated position.

8. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, a member located alongside the path of said trolleys on an upwardly extending leg of said conveyor in obstructing relation with a portion of said retarding dog to prevent movement of the retarding dog to its free position to cause a driving dog to lift said trolley by means of said retarding dog, said retarding dog having a first arm disposed adjacent said member and a second arm in the path of said driving dogs, resilient means urging said retarding dog into its retarding position, in which the second arm is in said driving dog path whereby said driving dog will move said retarding dog to its free position when the first arm of the retarding dog is lifted past said member, a holding pawl adjacent the path of said trolleys for preventing each trolley pushed by said driving dog past the end of said member from dropping, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means for moving the driven dog of each trolley into the path of said driving dogs causing a driving dog to lift the trolley along an upwardly extending leg of said conveyor.

9. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, a member located alongside the path of said trolleys on an upwardly extending leg of said conveyor in obstructing relation with a portion of said retarding dog to prevent movement of the retarding dog to its free position to cause a driving dog to lift said trolley by means of said retarding dog, said retarding dog having a first arm disposed adjacent said member and a second arm in the path of said driving dogs, resilient means urging said retarding dog into its retarding position, in which the second arm is in said driving dog path whereby said driving dog will move said retarding dog to its free position when the first arm of the retarding dog is lifted past said member, a plurality of holding pawls in spaced relation along said upwardly extending conveyor leg adjacent the path of said trolleys for independently supporting accumulated trolleys pushed by said driving dog past the end of said member, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means for moving the driven dog of each trolley into the path of said driving dogs causing a driving dog to lift the trolley along an upwardly extending leg of said conveyor.

10. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, a member located alongside the path of said trolleys on an upwardly extending leg of said conveyor in obstructing relation with a portion of said retarding dog to prevent movement of the retarding dog to its free position to cause a driving dog to lift said trolley by means of said retarding dog, said retarding dog having a first arm disposed adjacent said member and a second arm in the path of said driving dogs, resilient means urging said retarding dog into its retarding position, in which the second arm is in said driving dog path whereby said driving dog will move said retarding dog to its free position when the first arm of the retarding dog is lifted past said member, a holding pawl adjacent the path of said trolleys for preventing each trolley pushed by said driving dog past the end of said member from dropping, said holding pawl comprising a pivoted member spring-urged toward said trolley, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means for moving the driven dog of each trolley into the path of said driving dogs causing a driving dog to lift the trolley along an upwardly extending leg of said conveyor.

11. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, obstructing means located alongside the path of said trolleys on an upwardly extending leg of said conveyor in obstructing relation with a portion of said retarding dog to prevent movement of the retarding dog to its free position to cause a driving dog to lift said trolley by means of said retarding dog, said obstructing means comprising independently movable members arranged in succession alongside said upwardly extending leg of the conveyor, each member being movable between a first position in which a retarding dog of an adjacent trolley is held in its retarding position so as to be driven by a driving dog, and a second position in which said retarding dog is permitted to move to its free position and allow a driving dog to pass so that trolleys may be accumulated on said upwardly extending leg in downwardly cascading progression, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, and actuating means for moving the driven dog of each trolley into the path of said driving dogs causing a driving dog to lift the trolley along an upwardly extending leg of said conveyor.

12. In a closed loop power-and-free material handling system having downwardly and upwardly extending conveyor legs, a powered endless member movable along a path carrying spaced driving dogs, a series of workpiece-carrying trolleys supported for free movement alongside and parallel to said endless member, a retarding dog on each trolley movable to a retarding position in which it is engageable with a driving dog during travel in a downwardly extending leg of the conveyor causing the trolley to be moved by gravity as it follows the driving dog, said retarding dog being movable to a free position clear of said driving dogs, a member located alongside the path of said trolleys on an upwardly extending leg of said conveyor in obstructing relation with a portion of said retarding dog to prevent movement of the retarding dog to its free position to cause a driving dog to lift said trolley by means of said retarding dog, a driven dog carried by each trolley, means supporting said retarding and driven dogs in a manner permitting the driving dog to pass both dogs in response to blocking of trolley movement in a downwardly extending conveyor leg, said last-mentioned means comprising means constantly urging said driven dog toward a free position clear of the path of said driving dogs, actuating means for moving the driven dog of each trolley into the path of said driving dogs causing a driving dog to lift the trolley along an upwardly extending leg of said conveyor, said actuating means comprising a plurality of cams for actuating the driven dogs disposed alongside the upwardly extending conveyor leg, and means responsive to movement, by the uppermost cam, of the driven dog of the uppermost accumulating trolley into the path of said driving dogs to move the next lower cam into operative position for shifting the driven dog of its trolley.

13. A trolley for use in a power-and-free material handling system of the type having an endless member movable along a path with laterally extending driving dogs, said trolley comprising a retarding dog mounted for movement between a retarding position in the path of said driving dogs and a free position clear of said driving dogs, resilient means urging said retarding dog towards its retarding position, a driven dog on said trolley mounted for movement independently of said retarding dog between a free position clear of said driving dogs and a driven position in the path of said driving dogs, resilient means constantly urging said driven dog toward its free position, rail means guiding said trolley on an upward path of movement, and means adjacent and extending from the bottom of said path of movement to a predetermined height, said last-mentioned means preventing movement of said retarding dog to its free position whereby a driving dog will lift said trolley through said retarding dog, said last-mentioned means comprising a plurality of members independently movable toward and away from the path of said trolley whereby the retarding dogs of a series of trolleys may be released at progressively lower locations.

14. A trolley for use in a power-and-free material handling system of the type having an endless member movable along a path with laterally extending driving dogs, said trolley comprising a retarding dog mounted for movement between a retarding position in the path of said driving dogs and a free position clear of said driving dogs, resilient means urging said retarding dog towards its retarding position, a driven dog on said trolley mounted for movement independently of said retarding dog between a free position clear of said driving dogs and a driven position in the path of said driving dogs, said driven dog comprising a pivoted member having a first arm extending transversely to the path of movement of said trolley and a second arm extending parallel to said path of movement when the driven dog is in its free position, resilient means constantly urging said driven dog toward its free position, rail means guiding said trolley on a downward path followed by an upward path, a selectively movable actuating cam adjacent a portion of said upward path and engageable with said first arm of the driven dog to move the dog to its driven position, and a stop for preventing movement of said driven dog past its driven position when said first arm is engaged by a driving dog.

15. A trolley for use in a power-and-free material handling system of the type having an endless member movable along a path and provided with laterally extending driving dogs: means for guiding said trolley for movement along a course generally parallel to said path; a retarding dog on said trolley movable between a retarding position in the path of said driving dogs and a free position clear of the path of said driving dogs, said retarding dog being normally disposed in said retarding position; means for mounting said retarding dog to said trolley so that said retarding dog may be moved to said free position by a driving dog which overtakes and engages same; means for maintaining said retarding dog in said retarding position when it overtakes and engages a driving dog to prevent said trolley from moving ahead of said driving dog; a driven dog mounted on said trolley and movable between a free position clear of the path of said driving dogs and a driven position in the path of said driving dogs, said driven dog being normally disposed in said free position; means constantly biasing said driven dog towards said free position thereof in all positions thereof; means for moving said driven dog to said driven position against said bias; and means for maintaining said driven dog in said driven position thereof when overtaken and engaged by a driving dog, whereby said trolley will be moved along said course by said driving dog pushing on said driven dog.

16. A trolley as claimed in claim 15, wherein said means for maintaining said driven dog in said driven position includes stop means on said trolley engageable by a portion of said driven dog, and wherein said driven dog portion is maintained in engagement with said stop by the force of said driving dog pushing on said driven dog.

17. A trolley as claimed in claim 15, wherein said driven dog comprises a pivoted member having a first arm extending substantially transversely to the path of movement of said trolley and a second arm extending substantially parallel to said path of movement, when said driven dog is in its free position.

18. A trolley as claimed in claim 17, in combination with a cam disposed along the path of movement of said trolley and engageable with said first arm to cause said driven dog to be pivoted against said bias to said driven position.

19. A trolley as claimed in claim 18, wherein said trolley includes a stop which is engaged by said first arm when said driven dog is moved to said driven position.

20. A trolley as claimed in claim 15, wherein the path of movement of said trolley has a generally horizontal leg and a generally vertical leg, in combination with cam means for moving said driven dog to said driven position, said cam means being disposed on said horizontal leg immediately before said vertical leg.

21. A trolley as claimed in claim 15, in combination with a cam mounted for movement along a path generally parallel to the path of movement of said trolley, said means for moving said driven dog to said driven position being engageable with said cam for causing said driven dog to be moved to said driven position.

22. A trolley as claimed in claim 15, in combination with a plurality of adjacent cams disposed along the path of movement of said trolley, said means for moving said driven dog to said driven position being engageable with said cams for moving said driving dog to said driven position.

23. In a power-and-free material handling system of the type having an endless member movable along a path and provided with laterally extending drive dogs: a trolley; means for guiding said trolley for movement along a course generally parallel to said path; a retarding dog on said trolley movable between a retarding position in the path of said driving dogs and a free position clear of the path of said driving dogs, said retarding dog being normally disposed in said retarding position; means for mounting said retarding dog to said trolley so that said retarding dog may be moved to said free position by a driving dog which overtakes and engages same; means for maintaining said retarding dog in said retarding position when it overtakes and engages a driving dog to prevent said trolley from moving ahead of said driving dog; means adjacent a portion of said course for preventing movement of said retarding dog to said free position when overtaken by a driving dog, whereby said trolley will be moved along said course by said driving dog pushing on said retarding dog; a driven dog mounted on said trolley and movable between a free position clear of the path of said driving dogs and a driven position in the path of said driving dogs, said driven dog being normally disposed in said free position; and means constantly biasing said driven dog towards said free position thereof in all positions thereof.

24. A material handling system as claimed in claim 23, wherein said retarding dog comprises a pivoted member having a first arm extending substantially parallel to the path of movement of said trolley, and a second arm extending substantially transversely to said path of movement and into the path of movement of said driving dog, when said retarding dog is in its retarding position.

25. A material handling system as claimed in claim 24, further comprising stop means on said trolley engageable by said first arm to maintain said retarding dog in said retarding position when it overtakes and engages a driving dog.

26. A material handling system as claimed in claim 23, wherein said means adjacent a portion of said course comprises a fixed cam engageable with said retarding dog.

27. A material handling system as claimed in claim 23, wherein said means adjacent a portion of said course comprises a cam movable into and out of a position in which it is engageable by said retarding dog.

28. A material handling system as claimed in claim 23, wherein said means adjacent a portion of said course comprises a plurality of cams each engageable with said retarding dog.

* * * * *

UNITED STATES PATENT AND TRADEMARK OFFICE

CERTIFICATE OF CORRECTION

PATENT NO. : 4,030,423

DATED : June 21, 1977

INVENTOR(S) : Robert Krammer

It is certified that error appears in the above-identified patent and that said Letters Patent are hereby corrected as shown below:

| | |
|---|---|
| Column 1, line 43: | after "downwardly" insert --extending-- |
| Column 2, line 64: | after "and" insert --an-- |
| Column 5, line 56: | change "dogs" to --dog-- |
| Column 5, line 59: | change "shown" to --show-- |
| Column 6, line 36: | change "the" to --their-- |
| Column 6, line 64: | add quotation marks around "driven" |
| Column 7, line 1: | add quotation marks around "driven" |
| Column 7, line 13: | change "says" to --say-- |
| Column 9, line 41: | change "free" to --driven-- and change "driven" to --free-- |

UNITED STATES PATENT AND TRADEMARK OFFICE

CERTIFICATE OF CORRECTION

PATENT NO. : 4,030,423

DATED : June 21, 1977

INVENTOR(S) : Robert Krammer

It is certified that error appears in the above–identified patent and that said Letters Patent are hereby corrected as shown below:

Change inventor's address from "Royal Oak, Mich." to

--White Bear Lake, Minnesota--

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*